United States Patent [19]

Hara et al.

[11] Patent Number: 4,930,415

[45] Date of Patent: Jun. 5, 1990

[54] AUTOMATIC WEB GUIDE ROLLER CLEANING DEVICE

[75] Inventors: Akira Hara, Tokyo, Japan; John MacPhee, Rowayton, Conn.

[73] Assignee: Baldwin-Japan Limited, Tokyo, Japan

[21] Appl. No.: 301,044

[22] Filed: Jan. 24, 1989

[30] Foreign Application Priority Data

Feb. 10, 1988 [JP] Japan ..... 63-29659
Feb. 10, 1988 [JP] Japan ..... 63-16843[U]

[51] Int. Cl.[5] ..... B41F 13/54

[52] U.S. Cl. ..... 101/228; 101/425; 271/314; 29/110; 29/115; 198/494; 198/791; 226/49; 226/188

[58] Field of Search ..... 101/423, 228, 425, 219; 271/314, 902; 192/0.02 R, 0.052, 0.07; 74/848; 198/494, 495, 493, 619, 788, 789, 791, 781, 624, 854, 855, 856; 226/37, 49, 51, 152, 188; 29/110, 115

[56] References Cited

U.S. PATENT DOCUMENTS

| | | | |
|---|---|---|---|
| 1,825,119 | 9/1931 | Mug | 198/788 |
| 2,175,860 | 10/1939 | Walmann | 198/788 |
| 2,403,374 | 7/1946 | Kalmar et al. | 198/495 |
| 2,736,209 | 2/1956 | Christian | 198/854 |
| 2,915,167 | 12/1959 | Berger | 198/788 |
| 2,950,507 | 8/1960 | Keyser | 198/788 |
| 2,966,078 | 12/1960 | Wright | 198/854 |
| 3,376,758 | 4/1968 | MacKay | 198/854 |
| 3,469,751 | 9/1969 | Tyrner et al. | 226/188 |
| 3,519,183 | 7/1970 | Levine et al. | 226/49 |
| 3,568,821 | 3/1971 | Gronkvist | 198/788 |
| 3,902,418 | 9/1975 | Morishita et al. | 101/228 |
| 3,945,317 | 3/1976 | Brasa | 101/228 |
| 3,992,994 | 11/1976 | Mitter | 101/425 |
| 4,082,180 | 4/1978 | Chung | 198/788 |
| 4,781,116 | 11/1988 | Harada . | |

FOREIGN PATENT DOCUMENTS

| | | | |
|---|---|---|---|
| 2696418 | 12/1988 | France | 198/788 |
| 149449 | 7/1987 | Japan . | |
| 255150 | 11/1987 | Japan . | |
| 256657 | 11/1987 | Japan . | |

*Primary Examiner*—Eugene H. Eickholt
*Attorney, Agent, or Firm*—Morgan & Finnegan

[57] ABSTRACT

A multiplicity of web guide rollers in a printing machine incorporate motors therein provided with respective reduction units and each reduction unit is provided on the side of an output shaft with a mechanism such as a clutch, so that the rollers can rotate normally, reversely or idly. When the web guide roller is cleaned, the roller is rotated in a direction opposite to the running direction of the web, whereby the contamination on the surface of the roller is wiped off by the web. Since the rotating directions of the respective rollers are selected by the controller in association with running paths of webs, so that automatic cleaning of the web guide rollers can be effectively performed.

6 Claims, 3 Drawing Sheets

AUTOMATIC WEB GUIDE ROLLER CLEANING DEVICE

BACKGROUND OF THE INVENTION

1. Field of the Invention

The present invention relates to a web guide roller for a rotary printing machine, and more particularly to a web guide roller with an automatically cleaning device.

2. Description of the Prior Art

A web guide roller for guiding a web (a printing paper) running through a printing machine during a printing process is contaminated by ink, paper debris and the like as the printing time elapses. When the web guide roller is contaminated, the contamination is transferred to a printing paper surface to decrease the product quality. Accordingly, in a case of a newspaper rotary press, in order to clean the contamination having adhered to the web guide roller after the interruption of the printing work, an operator manually cleans respective web guide rollers with waste cloth impregnated by cleaning oil or the like.

In a printing machine such as a newspaper rotary press each having more than 100 web guide rollers in a single system, it requires considerable labor to clean the respective web guide rollers manually as described above, and it is very dangerous to clean the web guide rollers located at high positions. Depending on the positions of installation of the web guide rollers, it is difficult for the operator to access there or it is difficult to perform the cleaning work because of narrow space within the printing machine.

Now, a conventional guide roller, for example, a conveyor roller, incorporating a motor therein is constructed such that a motor with a reduction unit is provided in a roller body, the outer periphery of a stator of the motor is integrally fixed to the inner wall of the roller body, an output shaft of the reduction unit is concentrically jointed to one of opposite shaft ends of the roller, and the roller body is rotatable with respect to the opposite shaft ends. In this construction, when the motor is energized with the opposite shaft ends of the roller unrotatably fixed, the rotor cannot be rotated and the stator is rotated relatively to the rotor because the rotor shaft of the motor, that is, an output shaft of the reduction unit is unrotatably fixed to side frames. In other words, the roller body can be rotated with respect to the roller shaft.

In the normal method of use, i.e. when the both shafts are fixed to a machine frame, with the aforesaid conventional motor guide roller, it requires an extremely great force to desirably rotate the roller body by applying a force to the outer periphery thereof while the motor is not energized. If such conventional motor guide rollers are employed as the web guide rollers in the rotary printing machine, when the power is cut off, the roller bodies suffer from the problem that the roller bodies cannot be rôtated along with the running of the web and it is difficult to clean the web guide rollers manually.

SUMMARY OF THE INVENTION

It is an object of the present invention to overcome the above-described disadvantages of the prior art, and to provide a new web guide roller, which the rotation of the web guide roller in a printing machine is performed by a motor incorporated therein and, when the motor is not energized, the web guide roller can be desirably rotated by a very small torque applied to the outer periphery of the web guide roller, and further, to provide a means for automatically cleaning the web guide rollers by providing the above-described new guide rollers on a printing machine, particularly a rotary printing machine.

To achieve the above-described object, according to a first aspect of the present invention, there is provided a web guide roller comprising: a roller body for guiding a web; shafts intermediately jointed and rotatably supporting the roller body at opposite ends thereof; side frames for fixing the shafts; a motor whose stator is fixed to the interior of the roller body; and a reduction unit, an input shaft of which is connected to a rotor of the motor and an output shaft of which is connected to one of the shafts for rotatably supporting the rolling body at the opposite ends thereof; wherein there is provided a mechanism for allowing one of the shafts for rotatably supporting the roller body at the opposite ends thereof and the output shaft of the reduction unit to be engaged with or released from each other, a means for applying cleaning liquid to each of the web guide rollers and a means for predetermindly selecting a normal or a reverse rotating direction of the motor mounted in the web guide roller in association with changes in various running paths of the webs.

To achieve the above-described object, according to a second aspect of the present invention, there is provided a web guide roller comprising: a roller body for guiding a web; shafts intermediately jointed and rotatably supporting the roller body at opposite ends thereof; side frames for fixing the shafts; a motor whose stator is fixed to the interior of the roller body; and a reduction unit, an input shaft of which is connected to a rotor of the motor and an output shaft of which is connected to one of the shafts for rotatably supporting the roller body at the opposite ends thereof; wherein there are provided a mechanism for allowing the output shaft of the reduction unit to restrain or release the rotation thereof, the mechanism being fixed to one of the side frames bearing the output shaft of the reduction unit, and an automatic cleaning system including a means for applying cleaning liquid to each of the web guide rollers and a means for predetermindly selecting a normal or reverse rotating direction of the motor mounted in the web guide roller is association with changes in various running paths of the webs.

According to the first aspect of the present invention, when the motor incorporated in the body of the web guide roller is energized and a mechanism provided between the output shaft of the reduction unit connected to the motor and one of the shafts for supporting the roller body at the opposite ends thereof, such as a clutch, is brought into an engagement, a turning force is generated between the rotor and the stator of the motor. However, since the rotor of the motor is fixed to the side frames through the reduction unit and the mechanism, the turning force is applied to the stator of the motor due to the reaction. Further, since the stator is fixed to the roller body, the turning force is applied to the roller body. Since the roller body is rotatably supported on the shafts fixed to the side frames through bearings, the roller body is rotated.

Subsequently, when the motor is not energized and the mechanism provided between the output shaft of the reduction unit connected to the motor and one of the shafts for supporting the roller body at the opposite ends thereof is brought into a released state, the rotor of the motor and the reduction unit are released from the shafts connected to the side frames, whereby the roller body is supported on the shafts whose opposite ends are fixed to the side frames through the bearings. Then, when the body of the web guide roller is rotated by an external force, a force for turning the rotor is not generated because of a reverse gearing within the reduction unit and there is present a small resistance due to the rolling friction of the bearings, so that the roller body can be rotated by a very small external force.

According to the second aspect of the present invention, when the motor incorporated in the roller body is energized and the mechanism, such as a brake, is brought into an engagement, since the shafts rotatably supporting the roller body is connected to the rotor of the motor and to the output shaft of the reduction unit, the rotor of the motor is restrained in rotation to be fixed to the side frames, so that the roller body is rotated similarly to the first aspect of the invention. Subsequently, when the motor is not energized and the mechanism is brought into a released state, the shafts for rotatably supporting the roller body connected to the rotor of the motor and the output shaft of the reduction unit is released from the restraint, whereby the shafts are not restrained by the side frames and supported by the bearings mounted on the side frames to be rotatable, so that the roller body can be rotated by a very small external force similarly to the first aspect of the present invention.

When the web guide rollers of the printing machine are to be cleaned, the feed rate of the web is made slow and the printing is interrupted.

When the cleaning system is operated, the respective web guide rollers, which have been freely driven by the webs with the output shaft of the reduction unit incorporated therein and the side frames being released from each other, are rotated in a direction opposite to the running direction of the webs with the output shaft of the reduction unit and the side frames being connected to each other. However, since the webs are still fed in the normal direction at the slow feed rate, the contamination on the surfaces of the web guide rollers are wiped off by the webs. In this case, when the cleaning liquid is applied onto the web guide rollers, the contamination on the surface of the web guide rollers can be more satisfactorily wiped off.

In a newspaper rotary press, depending on the page layout, the running paths of the webs are varied, whereby web guide rollers installed at some positions are reversed in the rotating directions. Therefore, the motors for driving the web guide rollers are drivable in the normal or reverse direction. Furthermore, the controller programmably stores the rotating directions of the respective web guide rollers for the running paths of the respective webs, whereby, when the running paths of the respective webs are selected, the controller automatically controls the respective web guide rollers to rotate in the correct directions.

The newspaper rotary press is equipped with the new web guide rollers according to the present invention, provided with the means for applying the cleaning liquid to these web guide rollers and further provided with the device for controlling the rotating directions of the respective web guide rollers for the running paths of the webs, whereby, in cleaning the contamination on the web guide rollers, the conventional dangerous and troublesome manual works are eliminated, thereby enabling the manual works to be changed over to automatic cleaning works with high safety.

The above and other objects, novel features and advantages of the present invention will become more apparent from the following detailed description of preferred embodiments of the present invention when read in conjunction with the accompanying drawings.

DESCRIPTION OF THE PREFERRED EMBODIMENTS

Embodiments of the present invention will hereunder be described with reference to FIGS. 1 to 5.

Figure 1:
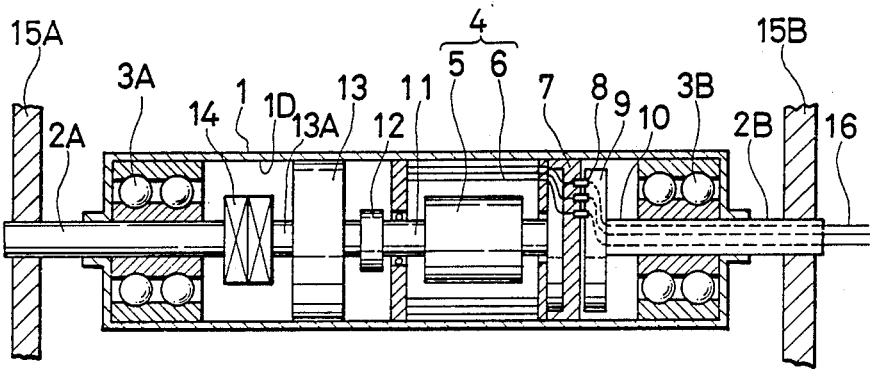
FIG. 1 is a cross-sectional view showing the web guide roller incorporating a mechanism therein according to a first embodiment of the present invention.

FIG. 1 is the sectional view showing the web guide roller according to the first embodiment of the present invention. A roller body 1 is supported by roller shafts 2A and 2B through bearings 3A and 3B at opposite ends, and, when a clutch 14 is released, even if the roller shafts 2A and 2B are restrained in rotation, the roller body 1 can be freely rotated by an external force. A motor 4 is provided in the roller body 1, and a stator 6 of the motor 4 is integrally fixed to an inner wall 1D of the roller body 1. An electric power supplied from an electrode 10 of a power-dispatch board 9 is directed to the stator 6 by a collector 8 of a power-collecting board 7. Power transmission to the power-dispatch board 9 is performed through a conductor 16 wired from the outside through a hollow portion in the center of axis of the roller shaft 2B.

An output shaft 11 of the motor 4 is engaged with a reduction unit 13 through a joint 12, and an output shaft 13A of the reduction unit 13 is connected to the roller shaft 2A on the same axis by a connectable or releasable clutch 14 such as an electromagnetic clutch.

The roller shafts 2A and 2B are supported by side frames 15A and 15B to be restrained in rotation.

With the above-described construction, when the motor 4 is energized with the clutch 14 being turned on to connect the output shaft 13A to the roller shaft 2A, the output shaft 11 of the motor, i.e. a rotor 5 does not rotate because the rotor 5 is restrained by the roller shaft 2A, but the stator 6 rotates relatively. That is, the roller body 1 is rotated. Similarly, when the roller body 1 is to be rotated by an external force such as manual turning with the clutch 14 being turned on and the power to the motor 4 being cut off, a very great external force is required similarly to a case in which a shaft of a reduction unit having a variable reduction ratio of 1/50–1/100 and connected to a motor is turned to give rotation to a motor. In consequence, it is impossible to rotate the roller body 1 lightly along with the running of the web as in the case of the web guide rollers in a rotary printing machine.

However, when the clutch 14 is turned off to release the output shaft 13A of the reduction unit from restraint, the roller body 1 becomes rotatable when subjected to a very small external force.

Figure 2:
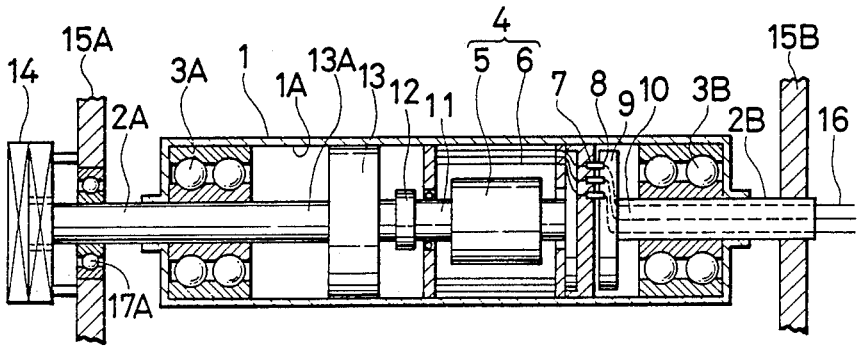
FIG. 2 is a cross-sectional view showing the web guide roller externally provided with a mechanism according to a second embodiment of the present invention.

FIG. 2 shows the second embodiment. In the first embodiment, the output shaft 13A of the reduction unit and the roller shaft 2A are formed separately of each other and connected to or released from each other by the clutch 14, whereas, in the second embodiment, the output shaft 13A of the reduction unit and the roller shaft 2A are formed of a single shaft. In, such an arrangement the roller shaft 2A is adapted to be rotatably supported by the side frame 15A through bearings 17A, and further, the roller shaft 2A, i.e. the rotor 5 can be restrained in rotation by the clutch 14, for example electromagnetic clutch, provided on one end of the roller shaft 2A.

It is obvious that the second embodiment can perform the function similar to that in the first embodiment.

According to the present invention, in each of the embodiments, the mechanism for mechanically releasing the rotor of the motor incorporated in the roller body from the side frame supporting the roller body, whereby, when the power fed to the motor is turned off and the roller body is rotated by an external force, the roller body can be supported only by the bearings, so that the roller body can be easily rotated by a very small external force.

Figure 3:
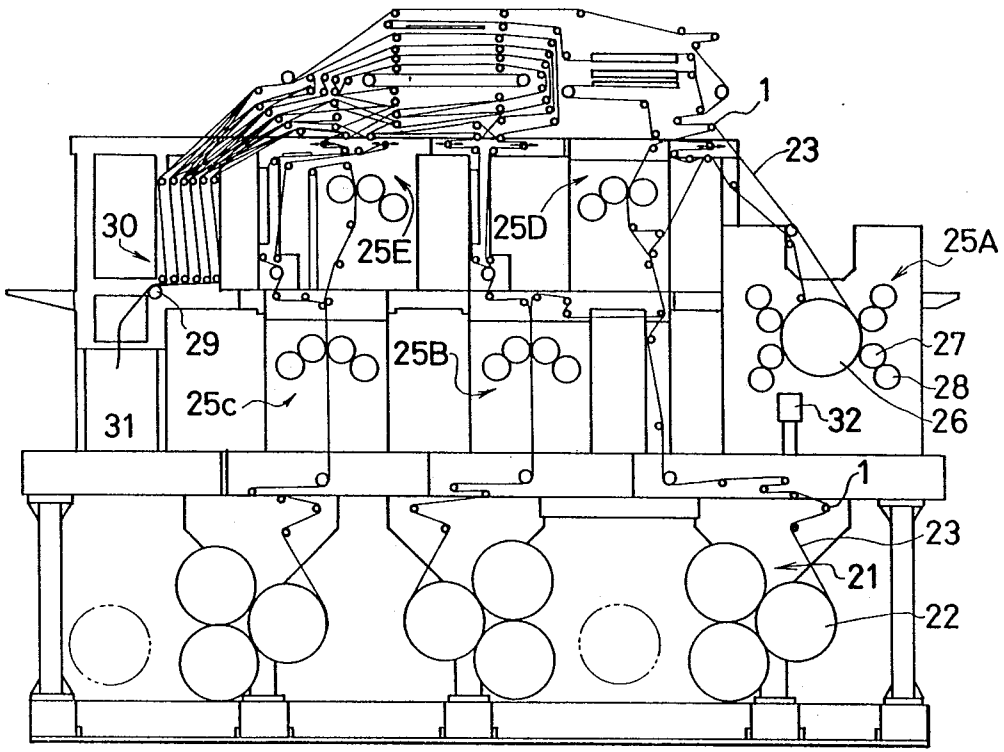
FIG. 3 is a side view showing a newspaper rotary press using the web guide rollers according to the present invention.

FIG. 3 shows the side view of the newspaper rotary press using the web guide rollers according to this invention. Webs 23 fed from web rolls 22 of a paper supply stand 21 are passed through a multiplicity of web guide rollers 1 and led to impression cylinder 26 of a multi-color printing unit 25A in a case of multiple color printing. Here, ink transferred from a plate cylinder 28 to a blanket cylinder 27 while being pressed against the impression cylinder 26 by the blanket cylinder 27 is transferred to the web 23, which is repeated during the passing process of the printing through the impression cylinder 26 in accordance with the number of colors used. The webs 23 which have completely printed, are led again to the multiplicity of web guide rollers 1, drawn by a drag roller 29, folded by a folding machine 30, and conveyed to the outside of the machine by a delivery conveyor (not shown).

When the web guide roller 1 is contaminated by the ink and needs to be cleaned after a lapse of the printing time, the printing machine is reduced in its operation speed, the blanket cylinder 27 and the plate cylinder 28 are released from the webs 23 and printing operation is interrupted. Since the paths of the webs 23 are left as they are and the webs 23 are drawn by the drag roller 29, the webs are not printed and remain as blank papers, folded by the folding machine and conveyed to the outside of the machine by the delivery conveyor.

In order to begin to clean the web guide roller 1, when a controller 32 of the automatic system is started, the cleaning liquid is applied to the respective guide rollers 1, simultaneously, the web guide rollers 1 are rotated reversely by the motors 4 incorporated in the web guide rollers 1, the contamination attached to the web guide rollers 1 is cleaned by the running webs 23 to produce clean surfaces.

Figure 4:
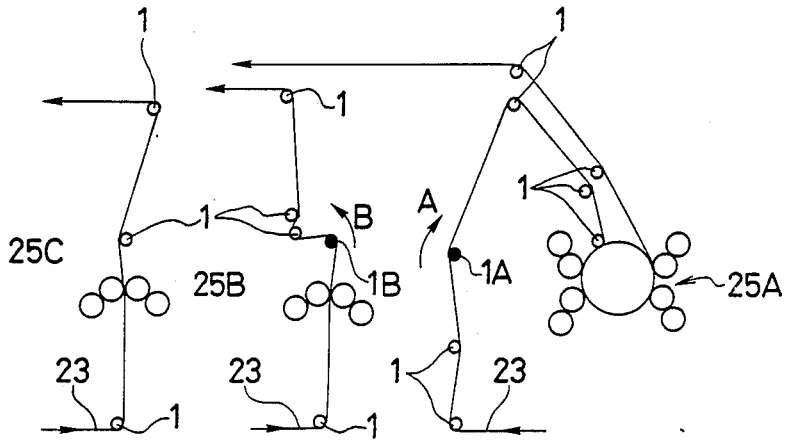
FIG. 4 is a side view showing running paths of the webs in the newspaper rotary press shown in FIG. 3.
Figure 5:
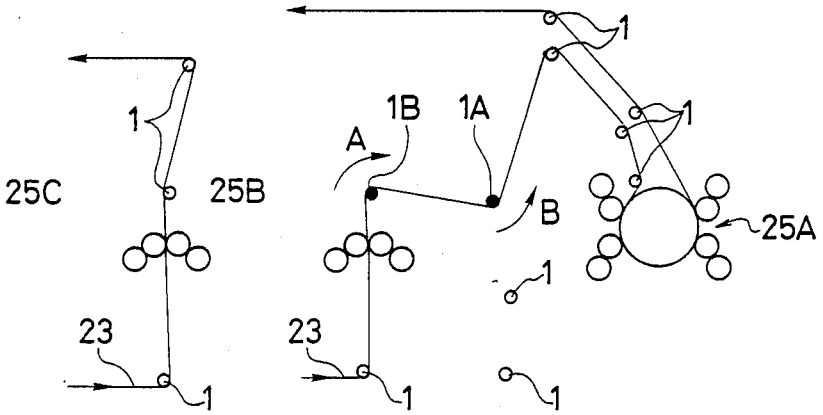
FIG. 5 is a side view in which the running paths of the webs in the newspaper rotary press shown in FIG. 3 are varied, whereby some of the web guide rollers are rotated reversely.

In the newspaper rotary press, the running paths of the webs 23 are varied depending on the page layout, whereby the web guide rollers 1 installed at some positions are reversed in rotation as indicated by 1A and 1B in FIGS. 4 and 5. Web guide rollers 1A shown by black color in a multi-color printing unit 25A shown in FIG. 4 are rotated in a direction A as being the clockwise direction and web guide rollers 1B shown by black color in a perfecting mono-color printing unit 25B are rotated in a direction B as being the counterclockwise direction. However, when the running paths are varied as shown in FIG. 5, the web guide rollers 1A are rotated in the direction B as being the counterclockwise direction and web guide rollers 1B are rotated in the directin A as being the clockwise direction. Accordingly, the motor 4 for driving the web guide rollers 1 is rotatable in both the normal and reverse directions, and the controller 32 stores the rotating directions of the respective web guide rollers 1 corresponding to the running paths of the respective webs, whereby the controller 32 can select the paths of the webs so that the respective web guide rollers 1 can be rotated in the correct directions and the cleaning liquid can be applied to the web guide rollers 1 along the paths of the webs.

The newspaper rotary press using the web guide rollers according to the present invention comprises a means for releasing the web guide rollers from the driving power source during the printing to be freely driven by the running web and for connecting the web guide rollers to the driving power source to rotate the web guide rollers reversely so that the contamination on the surfaces of the web guide rollers can be removed and a means for applying the cleaning liquid to the web guide rollers, whereby these means are automatically controlled, so that the surfaces of the web guide rollers can be automatically cleaned, thereby advantageously improving the efficiency of the cleaning operation.

What is claimed is:

1. A web guide roller with an automatic cleaning device comprising:

a roller body for guiding a web;

shafts intermediately jointed and rotatably supporting said roller body at opposite ends thereof;

side frames for fixing said shafts;

a motor whose stator is fixed to the interior of said roller body; and a reduction unit having an input shaft thereof connected to a rotor of said motor and an output shaft thereof connected to one of said shafts for rotatably supporting said roller body at opposite ends thereof; wherein there is provided a mechanism for allowing one of the shafts for rotatably supporting said roller body at the opposite ends thereof and said output shaft of said reduction unit to be engaged with or released from each other.

2. A web guide roller with an automatic cleaning device according to claim 1, wherein said automatic cleaning device includes:

a means for applying cleaning luqiud to the web guide roller; and a means for predeterminedly selecting a normal or a reverse rotating direction of the motor mounted in said web guide roller in association with changes in various running paths of the web.

3. A web guide roller with an automatic cleaning device comprising:

a roller body for guiding a web;

shafts intermediately jointed and rotatably supporting said roller body at opposite ends thereof;

side frames for fixing said shafts;

a motor whose stator is fixed to the interior of said roller body; and a reduction unit having an input shaft thereof connected to a rotor of said motor and an output shaft thereof connected to one of the shafts for rotatably supporting said roller body at the opposite ends thereof; wherein there is provided a mechanism for allowing said output shaft of said reduction unit to restrain or release the rotation thereof, said mechanism being fixed to one of said side frames bearing said output shaft of said reduction unit.

4. A web guide roller with an automatic cleaning device according to claim 3, wherein said automatic cleaning device includes:

a means for applying cleaning liquid to the web guide roller; and a means for predeterminedly selecting a normal or a reverse rotating direction of the motor mounted in said web guide roller in association with changes in various running paths of the web.

5. A web guide roller with an automatic cleaning device according to claim 3, wherein the mechanism comprises:

a rotatable disk fixed to an end of an extension from the output shaft of the reduction unit, said extension from said shaft being borne by a side frame; and a stationary disk fixed to said side frame through mounting members and opposed to said rotatable disk so as to be engageable therewith or releasable thereform.

6. A web guide roller with an automatic cleaning device according to claim 5, wherein said automatic cleaning device includes:

a means for applying cleaning liquid to the web guide roller; and a means for predeterminedly selecting a normal or a reverse rotating direction of the motor mounted in said web guide roller in association with changes in various paths of the web.

* * * * *